US005223021A

United States Patent [19]

Blenk et al.

[11] Patent Number: 5,223,021

[45] Date of Patent: Jun. 29, 1993

[54] IRON AS A CO-ADDITIVE IN REFINING CRUDE LEAD BULLION

[75] Inventors: Michael H. Blenk, Youngstown, N.Y.; Russell B. Diemer, Jr., Hockessin, Del.; John P. Hager, Golden, Colo.

[73] Assignee: E. I. Du Pont de Nemours and Company, Wilmington, Del.

[21] Appl. No.: 835,648

[22] Filed: Feb. 13, 1992

[51] Int. Cl.[5] ..... C22B 13/00

[52] U.S. Cl. ..... 75/702

[58] Field of Search ..... 75/701, 702

[56] References Cited

U.S. PATENT DOCUMENTS

| | | | |
|---|---|---|---|
| 2,110,445 | 3/1938 | Lefferrer | 75/702 |
| 2,765,328 | 10/1956 | Padgitt | 556/98 |
| 4,033,761 | 7/1977 | Di Martini et al. | 75/701 |
| 4,153,451 | 5/1979 | Crasto et al. | 75/432 |
| 4,333,763 | 6/1982 | Di Martini et al. | 75/432 |
| 4,404,026 | 9/1983 | Di Martini et al. | 75/702 |
| 5,100,466 | 3/1992 | Blenk | 75/702 |

FOREIGN PATENT DOCUMENTS

| | | | |
|---|---|---|---|
| 0007890 | 2/1980 | European Pat. Off. | 75/702 |
| 357245 | 1/1973 | U.S.S.R. . | |

OTHER PUBLICATIONS

"Sodium Treatment of Copper Dross", C. Bates and C. Di Martini Journal of Metals, Aug. 1986, pp. 43–45.

"Process for Separating Impurities from Crude Lead Bullion Via Sodium Metal Injection," M. B. Blenk, R. B. Diemer and J. P. Hager, International Symposium on Injection in Process Metallurgy, Feb. 21, 1991.

*Primary Examiner*—Melvyn J. Andrews

*Attorney, Agent, or Firm*—Charles E. Krukiel

[57] ABSTRACT

A process for using iron metal or an iron-containing sulfide reagent as a co-additive to extend the usefulness of sodium in refining crude lead bullion.

6 Claims, No Drawings

IRON AS A CO-ADDITIVE IN REFINING CRUDE LEAD BULLION

BACKGROUND OF THE INVENTION

The present invention relates to an improved process for purifying lead bullion, and, more particularly, to a process which uses sodium for causing beneficial separations in crude lead bullion in which the sulfur content is less than about 1.3% by weight. The improvement comprises adding iron or an iron-containing reagent to the molten bullion whereby arsenic can be concentrated in the speiss phase.

U.S. Pat. No. 4,404,026 describes a method for treating and separating lead from relatively impure crude lead bullion and the matte and speiss phases which coexist therein. The process is accomplished by adding chemical reagents, e.g., sodium-containing reagents, to the molten bullion followed by a controlled solidification of the blast furnace mixture to substantially separate a matte and speiss phase from a lead bullion phase, thereby eliminating the need for dross reverberatory furnace separation. Separation of the lead with acceptable levels of residual impurities, e.g., arsenic levels, tends to become more difficult when the crude lead bullion is more pure, i.e., when it contains no more than a small amount of sulfur, e.g., less than about 1.3% by weight.

When cleaner, i.e., more pure, crude bullions are contacted with molten sodium, the phase and component separations, described, for example, in U.S. Pat. No. 4,404,026, can be constrained by a lack of suitable reagent for the sodium to reduce and a minimal production of non-bullion components which make isolation and recovery of the respective phases difficult. Undesirable components can be retained in the equilibrium phases, and the bullion may have high residual arsenic, or the ratio of copper to lead in the matte phase, for example, may be unsatisfactory.

SUMMARY OF THE INVENTION

The present invention is an improvement in a process for concentrating elemental lead in crude lead bullion, in which the crude bullion contains arsenic and no more than about 1.3% by weight of sulfur and the process comprises adding sodium to the lead bullion in molten form and cooling the resulting mixture to form a matte phase, a speiss phase and a lead bullion phase, the improvement comprising adding to the molten bullion an iron-containing reagent selected from the group consisting of iron metal and an iron-containing sulfide reagent prior to or coincident with the sodium in an amount sufficient to convert substantially all of the arsenic present in the crude bullion to $Fe_2As$ which then concentrates in the speiss phase. The co-addition of iron or an iron-containing reagent with sodium to the molten lead bullion enhances the formation of the matte, speiss and lead bullion phases as well as the transfer of sulfur and copper to the matte phase and the transfer of arsenic to the speiss phase. The process of the invention is particularly applicable to crude lead bullion which is relatively pure, i.e., which contains arsenic and generally less than about 1.3% by weight of sulfur.

DETAILED DESCRIPTION OF THE INVENTION

A process for concentrating elemental lead (i.e., purifying crude lead bullion) in the crude bullion via sodium addition is described in U.S. Pat. No. 4,404,026, the teachings of which are incorporated herein by reference, and comprises casting molten bullion, generally at a temperature of from about 1100° C. to 1200° C.; cooling the cast bullion to a predetermined temperature in the range of from about 750° to 850° C. to form a partial matte crust over the surface; adding a sodium-containing reagent beneath the surface of the molten bullion pool; and further cooling the bullion whereby matte and speiss phases are solidified to allow their separation from the lead bullion phase which remains.

The prior art describes relatively impure crude bullions which contain from 1.3% by weight up to about 2.6% by weight of sulfur as lead sulfide or copper sulfide. When sodium metal is added to the molten crude bullion, it reduces the sulfide and allows separation of three distinct phases, i.e., a high copper, low lead, low arsenic "matte" phase; a high copper, high arsenic, low silver "speiss" phase; and a high lead, low copper, low arsenic refined bullion phase. When less than about 1.3% by weight sulfur is present in the crude bullion, the use of sodium to cause beneficial separation is limited by a lack of suitable reagent for the sodium to reduce and because of minimal production of non-bullion components which makes subsequent isolation and recovery of those phases difficult. The bullion may have high residual arsenic, and the ratio of copper to lead in the matte phase may remain low. A copper to lead ratio of greater than 3 and an arsenic level less than 2 wt. % in the matte phase indicates that the sodium treatment of the crude bullion has been efficient.

In the formation of the matte, speiss, and lead bullion phases, it is desired that certain elements be concentrated in particular phases in order to enhance the value and simply further processing of each phase. The use of iron or an iron-containing reagent with the sodium addition process results in the beneficial separation of the matte, speiss, and lead bullion phases. Sulfur and copper concentrate in the matte phase, arsenic and iron concentrate in the speiss phase, and lead and antimony concentrate in the bullion phase. By the use of iron in the sodium addition process, an iron or iron/copper speiss is formed rather than a copper speiss. In the matte phase, copper to lead ratios approaching about 4 and arsenic levels less than about 2 wt. % are attainable according to the process when applied to crude bullions containing less than 1.3 wt. % sulfur. When copper sulfide ($Cu_2S$ or $CuS$) is also added to the crude bullion, arsenic levels as low as 0.05 wt. % are achievable in the lead bullion phase.

The series of desirable reactions that occur when pyrite ($FeS_2$) is added as the iron-containing reagent to a crude bullion prior to sodium metal addition begins with the reduction of the pyrite by the sodium to form sodium sulfide ($Na_2S$) and liberate iron. The iron, in turn, reacts with any arsenic present to form $Fe_2As$, which becomes part of the speiss phase.

While the co-addition of iron to the sodium addition process is most applicable to relatively "clean" crude bullions such as those represented in Table I, the present invention is also applicable to more impure bullions, such as those, for example, with high copper and low sulfur levels. In impure bullions, however, the economic penalty of increased sodium use may out weigh the advantages of iron co-addition.

In systems which are low in arsenic, the amount of speiss formed may be small and difficult to isolate. In these systems a non-molten, iron-bearing phase may precipitate from solution hindering equilibrium phase separation. This phase can also hinder the beneficial partitioning of the components by encapsulating non-bullion components, including the unreacted iron-containing sulfide reagent.

TABLE I

| Composition of Typical Blast-Furnace Bullion Product (wt. %). | |
|---|---|
| Cu | 2.5–5.5 |
| Sb | 0.5–1.75 |
| Ag | 0.2–1.0 |
| Pb | 65–95 |
| Zn | 0.05–0.2 |
| Bi | 0.1–0.5 |
| As | 0.7–1.5 |
| S | 0.35–1.6 |
| Au | 0.0003–0.0006 |
| Fe | 0.1–0.8 |
| Sn | 0.04–0.17 |

The amount of sodium required is based on the amount necessary to convert all the sulfur (from PbS), and antimony to $Na_2S$ and $Na_3Sb$, respectively, and is termed a "stoichiometric sodium requirement". If no iron is used in treatment of the crude bullion, then the stoichiometric sodium requirement also includes the amount of sodium necessary to account for the arsenic. The stoichiometric sodium requirement is reduced by the amount of copper originally present in the crude bullion. Use of sodium in excess of the stoichiometric requirement enhances the fluidity of the matte phase, but system economics penalize excess sodium use. The suggested level of sodium use is about 80% to about 120% of the stoichiometric sodium requirement. The sodium-containing reagent may be metallic sodium, or $Na_2CO_3$, either alone or with coke, or it may be a reagent which is chemically equivalent to a sodium-containing reagent such as a reactive metal mixture intermediate by-product comprising sodium and calcium such as described in U.S. patent application Ser. No. 07/693,852 filed May 2, 1991 and allowed Oct. 21, 1991, the teachings of which are incorporated herein by reference.

The sodium-containing reagent should be added to the crude bullion at temperatures above about 750° C. At temperatures below about 750° C., generally not all phases are liquid and phase disengagement can be hampered. It is desirable to add the sodium below about 850° C., preferably at about 800° C., to prevent flashing sodium vapor for both safety and efficiecy reasons. As long as the sodium metal is injected beneath the surface of the bullion, temperatures as high as 870° C., but below the boiling point of sodium, may be feasible because the sodium appears to dissolve quickly in the bullion, and sodium reaction with other species may be rapid compared to loss via volatization. Other sodium-containing reagents may be added to the crude bullion at higher temperatures because the sodium liberated by the reagent reacts very quickly with the lead bullion. Sodium metal may be added to the crude bullion in the solid or molten state. In either case the sodium metal is injected below the surface of crust which forms on the top of the crude bullion to prevent the oxidation of sodium with air. When molten sodium metal is added, its temperature should be kept below its auto-ignition temperature of 120°–125° C. in accordance with standard handling practices for sodium metal. Sodium-containing reagents, other than sodium metal, should be added to the crude bullion in a manner similar to the procedures used for a reverberatory furnace.

The amount of iron required is based on the amount necessary to convert all the arsenic to $Fe_2As$ and is termed a "stoichiometric iron requirement". The stoichiometric iron requirement is reduced by the amount of iron originally present in the crude bullion. From about 50% to about 100% of the stoichiometric requirement is used. Iron may be added as iron metal, iron disulfide ($FeS_2$), pyrite, marcasite, $Fe_{(0.8-1.0)}S$, pyrrhotite, iron (II) sulfide, troilite, or iron (III) sulfide ($Fe_2S_3$). The use of iron-containing sulfide reagents increases the sodium stoichiometric requirement, as sodium must reduce the reagent before the iron is available to react with the arsenic. Therefore, while a sufficient amount of iron will reduce all the arsenic present in the system, the benefit of improved phase separation must be weighed against the economic penalty of increased sodium use when an iron-containing sulfide reagent is used as the iron source. The equivalence of $Fe_{(0.8-1.0)}S$ and $Fe_2S_3$ to $FeS_2$ as speiss-promoting co-additives with sodium was developed using a thermochemistry model based upon the F*A*C*T routine available through McGill University. (F*A*C*T: Facility for the Analysis of Chemical Thermodynamics) The thermochemical model is described in *International Symposium on Injection in Process Metallurgy*; Ed. by T. Lehner, P. J. Koros, and V. Ramachandran; The Minerals, Metals, & Materials Society, Warrendale, PA, 1991; pg. 299–323; Library of Congress No. 90-64035 and ISBN: 0-87339-163-2.

An iron-containing reagent could be combined with the crude bullion prior to the sodium addition. In commercial practice, the iron-containing reagent would be added to a cast mold prior to the casting of the crude bullion in order to effect mixing of the iron reagent with the bullion. Alternatively, it may be possible to add the iron-containing reagent at the same time as the sodium. If iron metal were to be used, the blast furnace charge could be adjusted to increase the iron metal level. This route, however, is limited by the solubility of the iron in the bullion at blast-furnace temperatures.

After cooling the treated crude bullion to about 350°–400° C., the matte and speiss phases are separated from the lead bullion for further processing. The lead bullion phase is ready for further refining steps.

EXAMPLE 1

Sodium Addition Without Iron Reagent

A pyrometallurgical laboratory experiment was conducted in a crucible containing approximately 1408.1 grams of crude bullion the composition of which is shown in Table II.

TABLE II

| Crude Bullion (wt. %) | |
|---|---|
| Cu | 5.11 |
| Sb | 0.39 |
| Ag | 0.204 |
| Pb | 91.2 |
| Zn | 0.09 |
| As | 1.5 |
| S | 1.27 |
| Na | 0.0 |
| Fe | 0.15 |
| Sn | 0.11 |

The granulated crude bullion was placed in a fireclay crucible and then brought to 800 C. in a stainless reactor within an electrically heated furnace. Once test temperature was achieved, a stainless steel probe was lowered such that its tip was below the surface of the melt. Cast rods of sodium metal, a total of 24.1 grams, were injected below the surface of the melt by means of a pure lead slug follower, 213.0 grams, within the injection probe. After injection, the probe was withdrawn and the system was allowed 8 hours to equilibrate at the test temperature. At the completion of the test, the furnace was opened and the system was shock cooled via cold air flow in order to preserve equilibrium phase compositions. After cooling, the test specimen was removed from the crucible, separated into its component phases, and analyzed for composition.

The targeted amount for sodium addition was 100% of the stoichiometric requirement. Sodium was added in an amount which was 97% of the stoichiometric amount necessary to react with all sulfur, arsenic, and antimony not already capable of being compounded with the copper present in the crude bullion. This corresponded to 1.46 wt. % of the total material in the starting crucible. Table III records the starting and post-test equilibrium phase compositions. Three equilibrium phases formed with generally desirable partitioning of elements among the phases. The speiss is primarily copper arsenide.

TABLE III

| Starting Crucible | | | | Equilibrium Crucible | | | | | |
|---|---|---|---|---|---|---|---|---|---|
| Crude Bullion | | | 1408.1 g. | Matte Phase | | | | 36.1 g. | |
| Sodium Metal | | | 24.1 g. | Speiss Phase | | | | 22.3 g. | |
| Lead Slug | | | 213.0 g. | Lead Bullion Phase | | | | 1441.9 g. | |
| | | | | MATTE | | | | | |
| Cu | 4.40% | Ag | 0.17% | Cu | 33.0% | Sn | 1.37% | Fe | 6.8% |
| S | 1.19% | Fe | 0.14% | S | 21.0% | As | 3.9% | Sb | 0.41% |
| Pb | 91.0% | Sb | 0.29% | Pb | 12.9% | Ag | 0.05% | Na | 19.3% |
| Sn | 0.094% | Na | 1.46% | | | Zn | 1.28% | | |
| As | 1.26% | Zn | 0.07% | | | | | | |
| | | | | SPEISS | | | | | |
| | | | | Cu | 49.5% | Sn | 0.37% | Fe | 2.7% |
| | | | | S | 7.8% | As | 14.3% | Sb | 1.96% |
| | | | | Pb | 10.4% | Ag | 0.06% | Na | 7.16% |
| | | | | | | Zn | 0.29% | | |
| | | | | BULLION | | | | | |
| | | | | Cu | 1.37% | | | Ag | 0.18% |
| | | | | S | 0.01% | | | Fe | 0.004% |
| | | | | Pb | 97.7% | | | Sb | 0.36% |
| | | | | Sn | 0.03% | | | Na | 0.007% |
| | | | | As | 0.35% | | | Zn | 0.002% |

Table IV gives the component distribution between phases and shows that for crude bullions low in sulfur, i.e., below about 1.3% by weight, the sodium addition process results in high levels of arsenic in the matte and bullion phases, and poor copper retention in the matte phase.

TABLE IV

| Example 1, Component Distribution Between Phases (%) | | | |
|---|---|---|---|
| | Matte | Speiss | Bullion |
| Cu | 27.9 | 25.8 | 46.2 |
| Sb | 2.6 | 7.6 | 89.8 |
| Ag | 0.7 | 0.5 | 98.8 |
| Pb | 0.3 | 0.2 | 99.5 |
| Zn | 83.2 | 11.6 | 5.2 |
| As | 14.6 | 33.0 | 52.0 |
| S | 80.1 | 18.4 | 1.52 |
| Na | 80.4 | 18.5 | 1.2 |
| Fe | 78.8 | 19.3 | 1.86 |
| Sn | 49.0 | 8.2 | 42.8 |

EXAMPLE 2

Sodium With Iron Reagent

In this Example pyrite was used to demonstrate the enhanced phase separation when iron is used in combination with the sodium addition process.

Example 2 was carried out in the same fashion as in Example 1 with the following exceptions. A sample of the same crude bullion, 1398.3 grams, shown in Table II was used. A total of 54.5 grams of sodium metal and a lead slug of 259.3 grams was used. Pyrite, 64.4 grams, was mixed with the crude bullion prior to heating.

The targeted amount for sodium addition was 100% of the stoichiometric requirement. Sodium was added in an amount which was 104.7% of the stoichiometric amount necessary to react with all antimony and sulfur, including that from the pyrite, not already capable of being compounded with the copper present in the crude bullion. This corresponded to 3.07 wt. % of the total material in the starting crucible. The difference between the 97% of Example 1 and the 104.7% of this Example would not be expected to yield results which are statistically or functionally different.

Table V records the starting and post-test equilibrium phase compositions. Improved partitioning of elements among the equilibrium phases occurred with the addition of the pyrite. Table VI gives the component distribution between phases and shows by the use of iron in the sodium addition process to treat crude bullions low in sulfur that arsenic concentrates in the speiss phase, and that copper and sulfur concentrate in the matte phase.

TABLE V

| Starting Crucible | | | | Equilibrium Crucible | | | | | |
|---|---|---|---|---|---|---|---|---|---|
| Crude Bullion | | | 1398.2 g. | Matte Phase | | | | 124.2 g. | |
| Sodium Metal | | | 54.5 g. | Speiss Phase | | | | 30.0 g. | |
| Lead Slug | | | 259.3 g. | Lead Bullion Phase | | | | 1476.1 g. | |
| Iron Pyrite | | | 64.4 g. | | | | | | |
| | | | | MATTE | | | | | |
| Cu | 4.0% | Ag | 0.16% | Cu | 21.3% | Sn | 0.22% | Fe | 20.5% |
| S | 2.94% | Fe | 1.81% | S | 24.6% | As | 0.02% | Sb | 0.07% |
| Pb | 86.4% | Sb | 0.31% | Pb | 5.61% | Ag | 0.03% | Na | 27.1% |
| Sn | 0.087% | Na | 3.07% | | | Zn | 0.87% | | |
| As | 1.18% | Zn | 0.07% | | | | | | |
| | | | | SPEISS | | | | | |
| | | | | Cu | 22.6% | Sn | 0.26% | Fe | 18.0% |
| | | | | S | 9.97% | As | 18.2% | Sb | 0.57% |
| | | | | Pb | 8.63% | Ag | 0.04% | Na | 10.6% |
| | | | | | | Zn | 0.35% | | |
| | | | | BULLION | | | | | |
| | | | | Cu | 0.52% | | | Ag | 0.17% |
| | | | | S | 0.025% | | | Fe | 0.006% |
| | | | | Pb | 98.53% | | | Sb | 0.36% |
| | | | | Sn | 0.13% | | | Na | 0.046% |
| | | | | As | 0.21% | | | Zn | 0.001% |

TABLE VI

| Component Distribution Between Phases (%) | | | |
|---|---|---|---|
| | Matte | Speiss | Bullion |
| Cu | 64.6 | 16.6 | 18.8 |
| Sb | 1.6 | 3.1 | 95.3 |
| Ag | 1.4 | 0.5 | 98.1 |
| Pb | 0.5 | 0.2 | 99.3 |
| Zn | 90.0 | 8.8 | 1.2 |
| As | 0.3 | 63.6 | 36.1 |
| S | 90.1 | 8.8 | 1.1 |
| Na | 89.7 | 8.5 | 1.8 |
| Fe | 82.0 | 17.7 | 0.29 |
| Sn | 12.1 | 3.4 | 84.5 |

We claim:

1. In a process for concentrating elemental lead in relative pure crude lead bullion which contains not more than about 1.3% by weight sulfur as sulfide and comprises adding sodium to the molten crude bullion and cooling the resulting mixture to form a matte phase, a speiss phase and a lead bullion phase, the improvement comprising adding to the molten crude bullion an iron-containing reagent selected from the group consisting of iron metal and an iron-containing sulfide reagent prior to or simultaneously with the sodium in an amount sufficient to convert substantially all arsenic present in the crude bullion to $Fe_2As$ and become part of the speiss phase.

2. The process of claim 1 in which the amount of iron-containing reagent added to the molten crude bullion is from 50% up to 100% of the iron stoichiometric requirement.

3. The process of claim 1 in which the iron-containing sulfide reagent is iron disulfide ($FeS_2$), pyrite or marcasite.

4. The process of claim 1 in which the iron-containing sulfide reagent is $Fe_{(0.8-1.0)}S$, pyrrhotite, iron (II) sulfide, or troilite.

5. The process of claim 1 in which the iron-containing sulfide reagent is iron (III) sulfide ($Fe_2S_3$).

6. In a process for concentrating elemental lead in crude lead bullion which contains not more than 1.3 wt % of sulfur as sulfide comprising:

(a) forming a pool of molten lead;

(b) casting the bullion into a heat resistant mold; and (c) cooling the cast bullion to a temperature in the range of from about 750° C. up to about 850° C. to form a partial matte crust over the surface of the bullion, the improvement comprising adding an iron-containing reagent prior to the casting of the bullion, then adding a sodium-containing reagent after the partial matte crust has formed or simultaneously adding the iron-containing reagent and the sodium-containing reagent to the bullion after the partial matte crust has formed whereby the sulfide is reduced and substantially all arsenic is converted to $FE_2As$; and (d) cooling the lead bullion to a solidification temperature.

* * * * *